US006882515B2

(12) United States Patent
Takeuchi et al.

(10) Patent No.: US 6,882,515 B2
(45) Date of Patent: Apr. 19, 2005

(54) OPERATION CIRCUIT AND POWER SWITCHING DEVICE EMPLOYING THE OPERATION CIRCUIT

(75) Inventors: Toshie Takeuchi, Tokyo (JP); Mitsuru Tsukima, Tokyo (JP); Yasushi Takeuchi, Tokyo (JP); Kenichi Koyama, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/721,893

(22) Filed: Nov. 26, 2003

(65) Prior Publication Data

US 2004/0201943 A1 Oct. 14, 2004

(30) Foreign Application Priority Data

Mar. 24, 2003 (JP) ..... 2003-080014

(51) Int. Cl.[7] ..... H01H 47/00; H01H 47/32

(52) U.S. Cl. ..... 361/160; 361/167; 361/168.1; 361/169.1

(58) Field of Search ..... 361/160, 166–169.1; 335/256, 266–268; 251/129.09, 129.1; 123/90.11

(56) References Cited

U.S. PATENT DOCUMENTS 4,086,645 A 4/1978 Gorman et al.
6,024,059 A * 2/2000 Kamimaru et al. ..... 123/90.11
6,046,423 A 4/2000 Kishida et al.
6,295,191 B1 9/2001 Kishida et al.
6,353,376 B1 3/2002 Takeuchi et al.

FOREIGN PATENT DOCUMENTS

| | | |
|---|---|---|
| GB | 2 299 896 | 3/2000 |
| JP | 2001-256868 | 9/2001 |
| JP | 2002-33034 | 1/2002 |

* cited by examiner

*Primary Examiner*—Ramon M. Barrera
(74) *Attorney, Agent, or Firm*—Leydig, Voit & Mayer, Ltd.

(57) ABSTRACT

In an operation circuit of an electromagnetic switching device, when electric energy is discharged by discharge switches connected in series, respectively, to opening coils and closing coils, an induction current flowing in a direction opposite to a current of the coil of the excitation side is generated. The current flows through the coil on the non-excitation side due to magnetic coupling, and a magnetic flux necessary for driving is cancelled, thereby inhibiting generation of a driving force. The operation circuit includes first and second opening and closing coils, so that a moving element may be driven between those coils. This circuit includes a circuit for suppressing an over-voltage at the moment of interrupting an excitation current of a first coil and for interrupting an induction current generated through the first coil at the time of exciting the second coil.

13 Claims, 12 Drawing Sheets

OPERATION CIRCUIT AND POWER SWITCHING DEVICE EMPLOYING THE OPERATION CIRCUIT

BACKGROUND OF THE INVENTION

1. Field of the Invention

The present invention relates to an operation circuit for use in, for example, a power switching device.

2. Description of the Related Art

Hitherto, in an operation circuit for use in an operation mechanism to drive a power switching device, as shown on page 4 and FIGS. 9 to 11 of the Japanese Patent Publication (unexamined) No. 033034/2002, two discharge switches such as thyristors are provided and controlled from outside, and turned ON in synchronization with an opening command or a closing command, and are turned OFF at the moment of completion of such opening operation or closing operation.

In the mentioned conventional operation circuit for use in an operation mechanism to drive a power-switching device of above arrangement, there exist the following problems.

In the conventional operation circuit, an opening coil and a closing coil are connected in parallel to capacitors, and electric energy is discharged by discharge switches connected in series to these two coils, respectively. In this known arrangement, the mentioned opening coil and closing coil are disposed adjacent to each other within the operation mechanism. Accordingly, a problem exists in that any induction current, which flows in a direction opposite to a current direction of the coil of the excitation side, is generated through the coil of the non-excitation side due to magnetic coupling when current is carried. Thus a magnetic flux necessary for driving is cancelled, and the generation of a driving force is inhibited.

Moreover, since the state of the magnetic coupling changes in a supersensitive manner depending on a relative positional relation between a moving element being in the stopped state and the mentioned opening coil and closing coil, another problem exists in that the operation is not stable.

SUMMARY OF THE INVENTION

The present invention was made to solve the above-discussed problems, and has an object of providing a highly reliable operation circuit in which driving characteristics are improved, as well as a stable performance is achieved. Another object of the invention is to provide a power-switching device employing this operation circuit.

In an operation circuit of an operation mechanism according to the invention that includes a pair of coils and is arranged so that a moving element may be driven between the mentioned coils; there is connected means for suppressing an over-voltage at the moment of interrupting an excitation current of one of the coils as well as for interrupting an induction current generated through the one coil at the time of exciting the other coil.

As a result, it is possible to significantly improve operation efficiency of the operation mechanism, as well as to protect the coils from being in conditions of the over-voltage.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Several preferred embodiments according to an operation circuit relating to the present invention are hereinafter described referring to the accompanying drawings.

Embodiment 1

Figure 1:
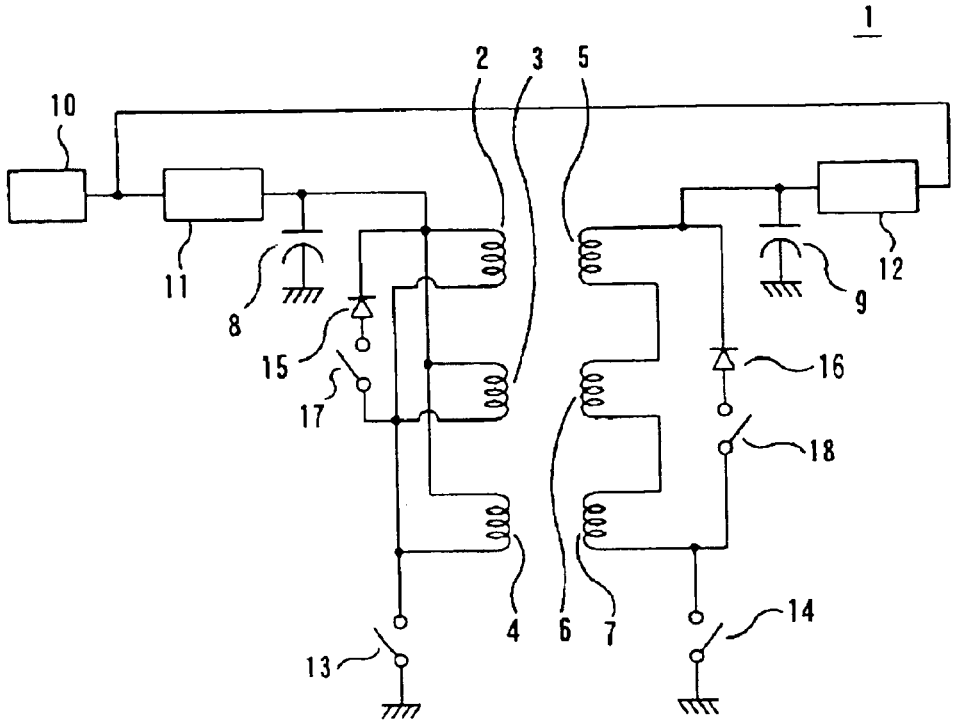
FIG. 1 is an operation circuit diagram according to the present invention.

FIG. 1 is a circuit diagram showing an example of an operation circuit according to the invention. An operation circuit 1 according to the invention is comprised of opening coils 2–4, closing coils 5–7, an opening capacitor 8 that is a source of current for exciting an opening operation, a closing capacitor 9 that is a source of current for exciting a closing operation, a DC power supply 10 for charging the capacitors and converters 11, 12 for rectifying a charge voltage of the capacitors, a discharge switch 13 discharging an electric energy of the opening coil, a discharge switch 14 discharging an electric energy of the closing coil, a diode 15 protecting the opening coils from being in over-voltage conditions generated upon making an electric energy of the opening coils OFF with the use of the mentioned switch 13, an diode 16 protecting the closing coils from being over-voltage conditions generated upon making an electric energy of the closing coils OFF with the use of the mentioned discharge switch 14, an induction interruption switch 17 causing a current path of the diode 15 to be ON at the time of excitation, and an induction interruption switch 18 causing a current path of the diode 16 to be OFF at the time of non-excitation.

As the current sources 8, 9, a capacitor is used, for example.

Further, in the drawing, the diode 16 and the induction interruption switch 18 are connected in parallel to the coils and connected in serial to each other, as means for suppressing the over-voltage upon interrupting an excitation current for the closing coils as well as for interrupting an induction current generated through the closing coils at the time of exciting the opening coils.

Likewise, the diode 15 and the induction interruption switch 17 are connected in parallel to the coils and connected in serial to each other, as means for suppressing the over-voltage upon interrupting an excitation current for the opening coils, as well as interrupting an induction current generated through the opening coils at the time of exciting the closing coils.

Figure 2:
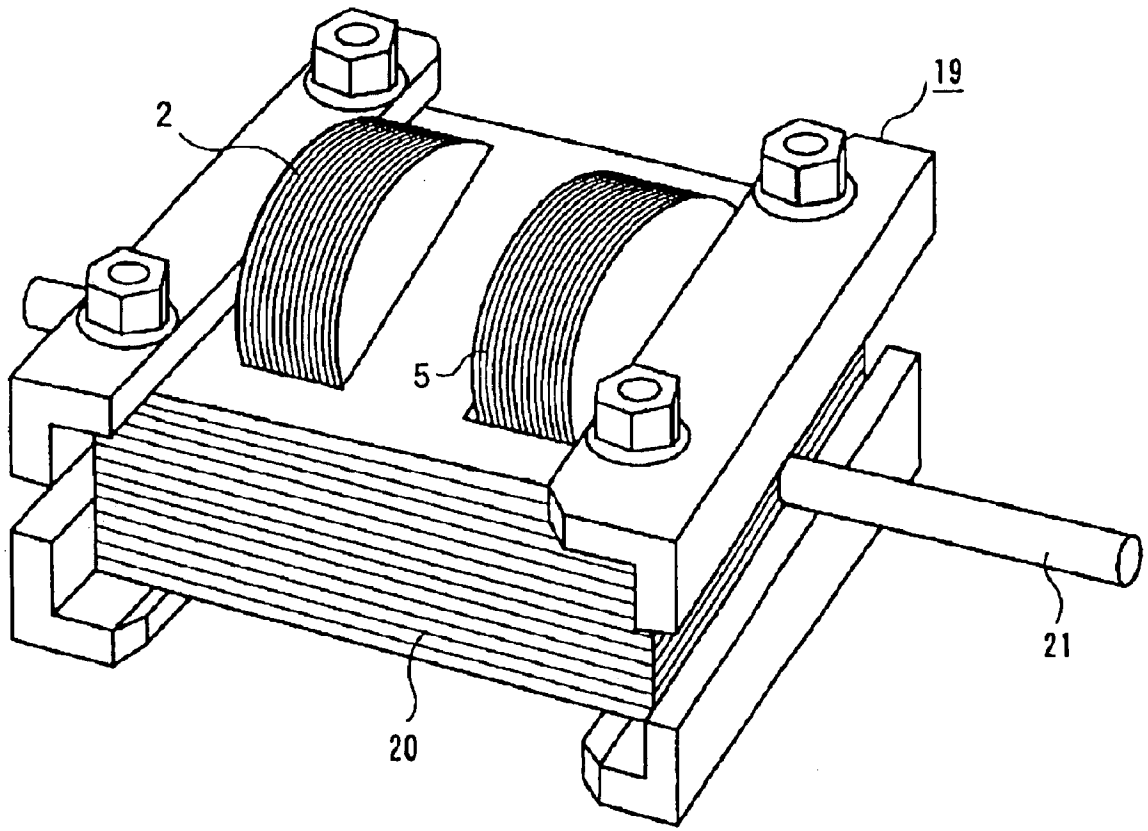
FIG. 2 is a perspective view showing an operation mechanism of a power-switching device according to the invention.
Figure 3:
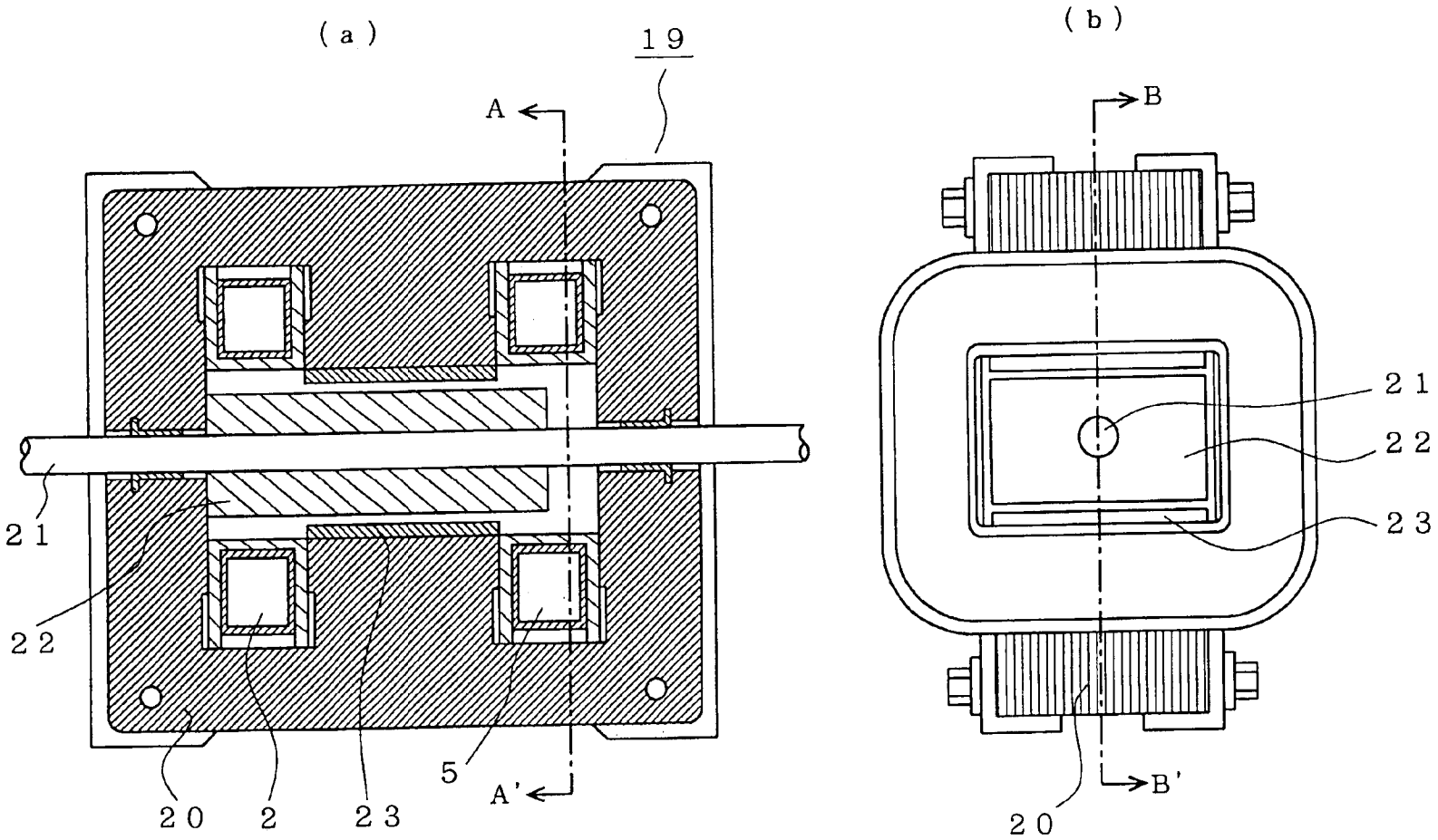
FIGS. 3 (*a*) and 3 (*b*) are internal cross sectional views of each part showing an opening state of the operation mechanism of the power switching device according to the invention.

FIG. 2 is a perspective view showing an example of an operation mechanism 19 for carrying out an opening and closing operation using the mentioned operation circuit. FIG. 3 (*a*) is a cross sectional view of an internal part of this perspective view taken along the line IIIa—IIIa of FIG. 3(*b*). FIG. 3(*b*) is a cross sectional view taken along the line IIIb—IIIb of FIG. 3(*a*).

In the drawings, the opening coil and closing coil are disposed in such a manner as to be surrounded at an outer circumferential portion thereof by a yoke in an axial direction of a connection rod 21, as well as to be substantially in parallel to each other with a space formed therebetween via the yoke 20; and to surround the outside of this connection rod 21 coaxially therewith in a direction perpendicular to an axis of this connection rod.

In addition, a moving element 22 is fixed to an outer circumferential portion of the connection rod 21, and is in the state of being capable of performing a reciprocating motion in an axial direction of this connection rod.

A permanent magnet 23 to hold the foregoing moving element 22 when the mentioned operation mechanism 19 is in the opening state or the closing state is disposed in such a manner as being fixed to the inside portion of the mentioned yoke with a space formed with respect to this moving element right outside of the moving element 22.

Further, the operation mechanism 19 arranged like this drives the mentioned moving element 22 to be in the opening or closing state with the use of the mentioned operation circuit 1.

Besides, FIGS. 3(*a*) and 3(*b*) show conditions in which the moving element 22 is driven to be in the opening state and to be held in this state with the mentioned operation circuit 1 using the operation mechanism 19.

Figure 4:
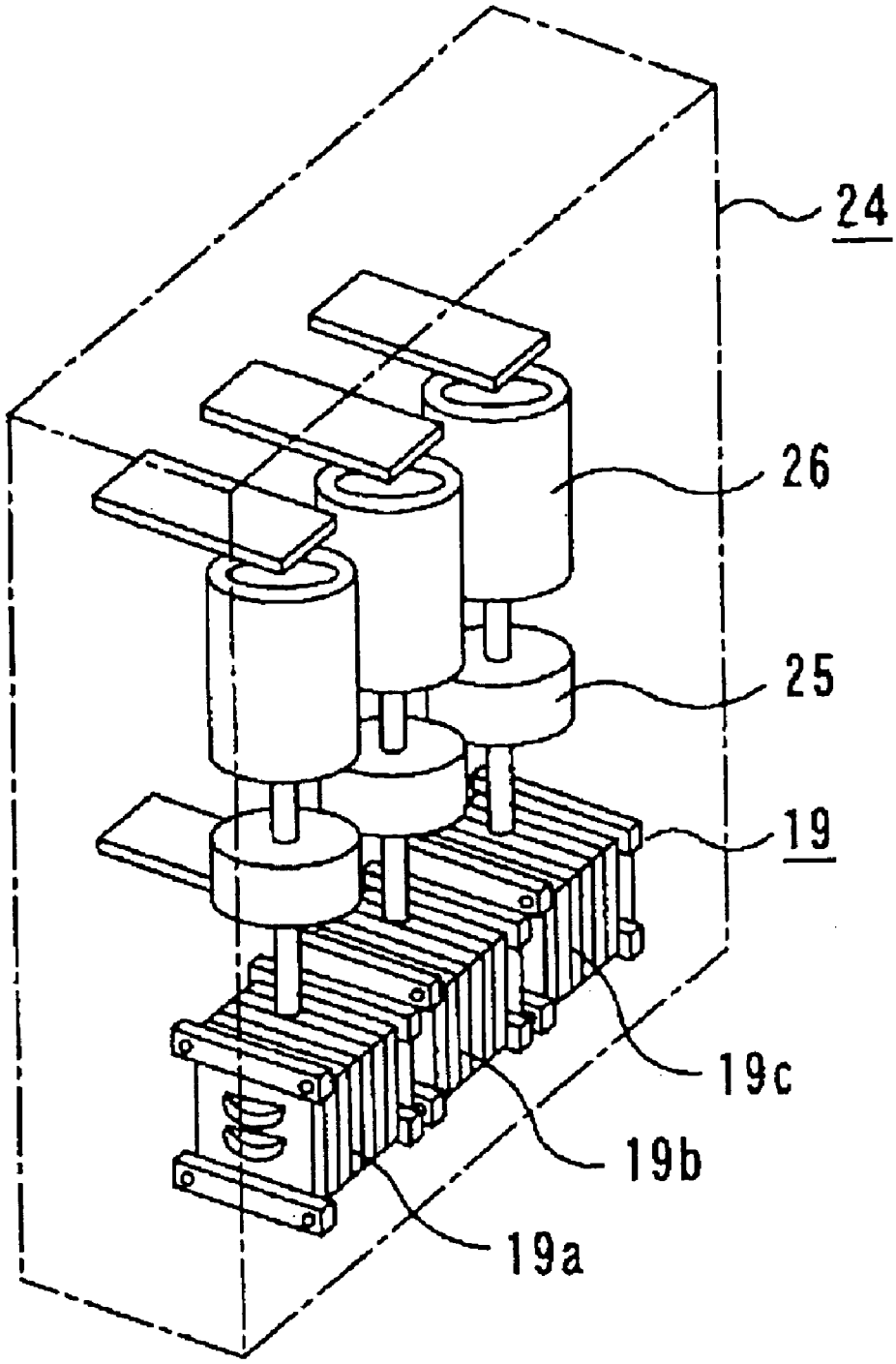
FIG. 4 is a perspective view showing an example of the power-switching device according to the invention.
Figure 5:
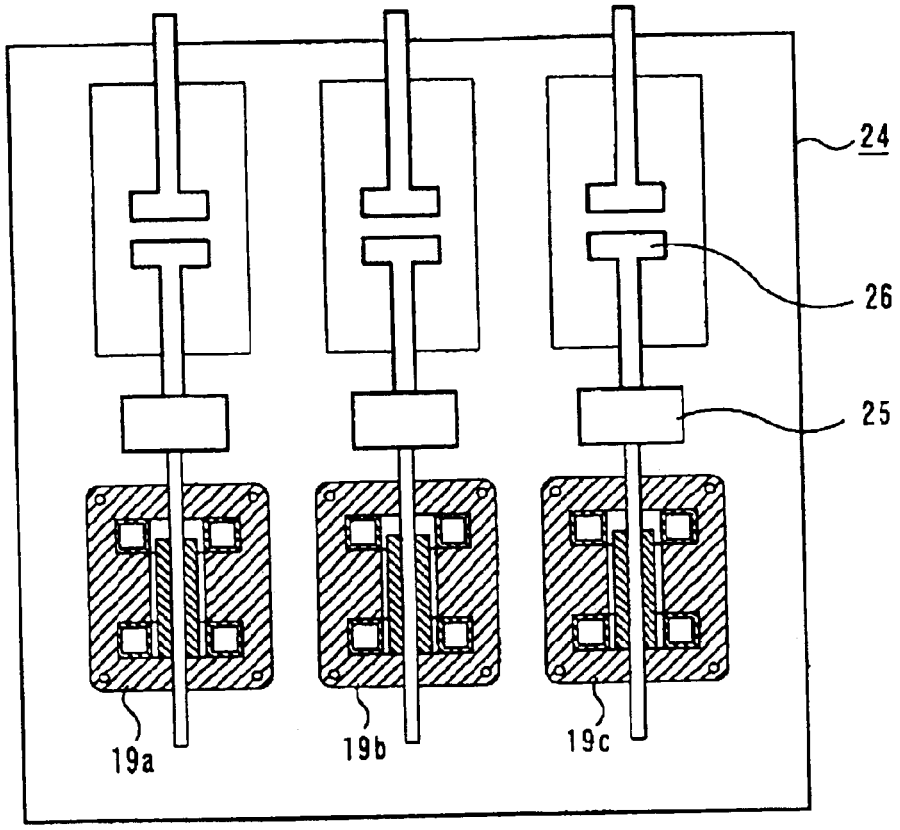
FIG. 5 is a cross sectional view of an internal part of the power-switching device shown in FIG. 4.

FIG. 4 is a perspective view showing an example of a power switching device 24 performing interruption and application of current with the use of the mentioned operation mechanism 19. FIG. 5 is a cross sectional view of an internal part of the power switching device 24 on which the mentioned operation mechanism 19 is mounted.

Referring to the FIGS. 4 and 5, the mentioned operation mechanism 19 is connected to a vacuum valve 26 via an insulator 25.

In addition, referring to FIGS. 4 and 5, three operation mechanisms 19*a*, 19*b*, 19*c* are mounted respectively relative to each phase of a three-phase switching device. However, even in the case where a three-phase linkage is disposed and one operation mechanism 19 is mounted relative to the three phases, the device effectively acts as a power switching device to perform operations of interrupting and carrying current.

Now, an opening operation is described with reference to FIGS. 1, 3(*a*) and 3(*b*).

A charge voltage of the capacitor 8 is charged to be a set value by a DC power supply 10.

The discharge switch 13 is a switch capable of being controlled from outside, for example, by a thyristor switch, which is made ON in synchronization with an opening command whereby current is discharged to the opening coils 2–4 connected in parallel to the capacitor 8. Then the moving element 22 moves from the closing state to the opening state due to an electromagnetic force, and is held in the opening state by the force of a magnetic flux provided by the permanent magnet 23.

At this time, at the opening coils 2–4, to protect the opening coils 2–4 from being in conditions of an over-voltage Vo that is generated based on the under-described Expression (1) upon making a discharge current OFF with the discharge switch 13, the diode 15 and the induction interruption switch 17 for the circulation are disposed in parallel to the opening-coils. The induction interruption switch 17 is in ON state.

$$Vo = L\text{coil} \cdot di/dt \quad (1)$$

Where: Lcoil denotes inductance of the coil, and di/dt denotes the rate of falling of current at the moment of making current OFF.

In the case of, e.g., thyristor switch, since current comes to be zero instantaneously, di/dt becomes an extremely large value, and voltage Vo generated between the coil terminals becomes significantly large, thereby making it possible to result in dielectric breakdown of the coils. Therefore, the induction interruption switch 17 is made ON.

Likewise, at the closing coils 5–7, which are connected in serial to the other closing capacitor 9, the diode 16 and the induction interruption switch 18 for the circulation are disposed in parallel to the closing coils. Further, the induction interruption switch 18 is ON state.

At this time, by making OFF the mentioned induction interruption switch 18 before the discharge switch 13 for opening is ON, it is possible to cut an induction current generated through the closing coils 5–7 that are coupled to the opening coils 2–4 due to magnetic coupling.

Since this induction current cancels a magnetic flux to excite an opening operation, operation efficiency can be enormously improved by cutting the mentioned induction current.

Furthermore, one capacitor is disposed respectively corresponding to each of the excitation side and the non-excitation side, so that an individual operation becomes possible relative to each of the opening side and the closing side.

Figure 6:
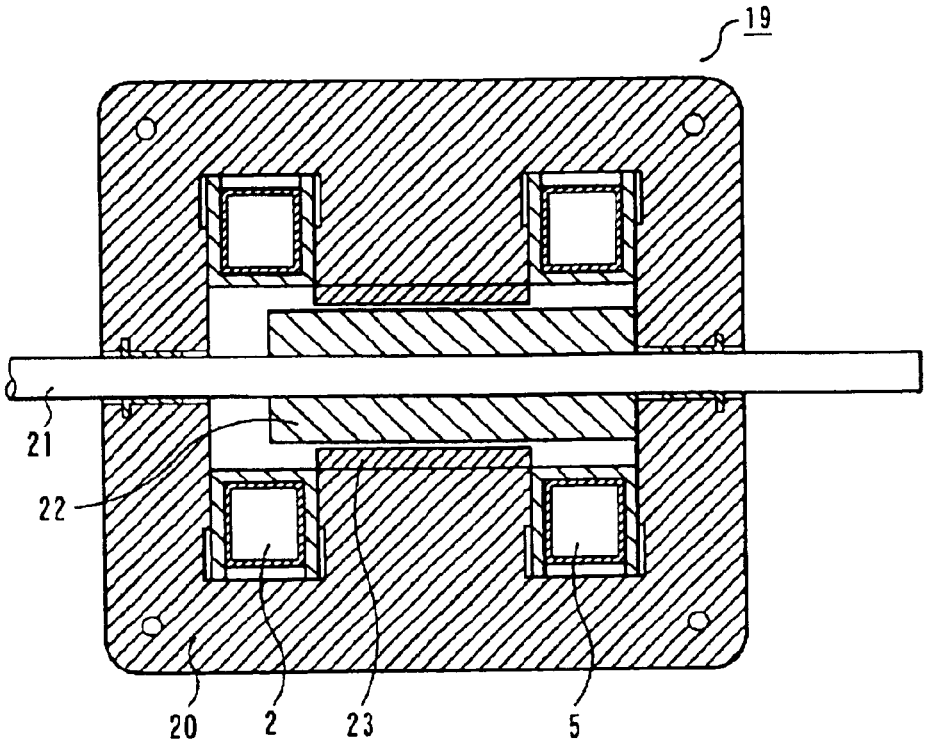
FIG. 6 is across sectional view of an internal part showing a closing state of the operation mechanism of the power switching device according to the invention.

Now, a closing operation is described with reference to FIGS. 1 and 6.

A charge voltage of the closing capacitor 9 is charged to be a set value by the DC power supply 10.

The discharge switch 14 is a switch capable of being controlled from outside, for example, a thyristor switch, which is made ON in synchronization with a closing command whereby current is discharged to the closing coils 5–7 connected in serial to the closing capacitor 9. Then the moving element 22 moves from the opening state to the closing state due to electromagnetic force, and is held in the closing state by the force of a magnetic flux provided by the permanent magnet 23.

At this time, at the closing coils 5–7, to protect the closing coils 5–7 from being in conditions of an over-voltage Vo that is generated according to the mentioned expression (1) upon making a discharge current OFF with the discharge switch 14, the diode 16 and the induction interruption switch 18 for the circulation are disposed in parallel to the closing coils 5–7. The induction interruption switch 18 is in ON state.

Lcoil in the foregoing expression (1) denotes inductance of the coil, and di/dt denotes the rate of falling of current upon making current OFF.

In the case of, e.g., thyristor switch, since current comes to be zero instantaneously, di/dt comes to be an extremely large value, and voltage Vo generated between the coil terminals becomes significantly large thereby making it possible to result in breakdown of the insulating film of the coil. Therefore, the induction interruption switch 18 is made ON.

Likewise, at the opening coils 2–4, which are connected in parallel to the other opening capacitor 8, the diode 15 and the induction interruption switch 17 for the circulation are disposed in parallel to the opening coils. Further, the induction interruption switch 18 is in ON state.

At this time, by making OFF the mentioned induction interruption switch 17 before the discharge switch 14 for closing is ON, it is possible to cut an induction current generated at the opening coils 2–4 that are coupled to the closing coils 5–7 due to magnetic coupling.

Since this induction current cancels a magnetic flux to excite a closing operation, operation efficiency can be enormously improved by cutting the mentioned induction current. The other effects are the same as those having been described in the case of the opening operation.

In addition, referring to FIG. 1, providing only one charge circuit including the DC power supply 10 with respect to the opening capacitor 8 and the closing capacitor 9 enables reduction in cost.

Further, referring to FIG. 1, the serial connection between the closing coils 5–7 results in no conduction of current to any of the closing coils 5–7 in the case of occurring any fault at the mentioned closing coils 5–7 or at the wiring to the mentioned closing coils. Thus, it is possible to prevent conditions that any of the three phases is not closed.

Furthermore, the serial connection makes impedance in the circuit larger and makes the flow of current smaller, and therefore acceleration is decreased thereby enabling to reduce shock exerted on the vacuum valve 62 at the time of closing.

Any of the mentioned advantages allows for improvements in reliability as a circuit breaker.

Although connecting the closing coils in series is shown herein, the serial connection of the opening coils in like manner enables to bring the same advantages as described above.

Although not described in this first embodiment, the charge circuit of a capacitor may be either connected or be disconnected by means of a switch at the time of discharging electric energy to the coils. There is no difference in advantages of the invention between the two states.

Embodiment 2

An example of connecting the closing coils in series is shown in the foregoing first embodiment, however, the serial connection of the opening coils likewise enables to achieve the same advantages as described above.

Embodiment 3

By connecting the opening coils 2–4 in,parallel as shown in FIG. 1, a total impedance of the circuit can be reduced, are smaller capacity of the capacitor 8 and an opening operation requiring a high-speed operation can be achieved, thus reduction in cost of the power supply and a higher-performance of the opening operation being attained. Although connecting the opening coils in parallel is shown herein, the parallel connection of the closing coils in like manner enables the same advantages as described above.

Embodiment 4

Figure 7:
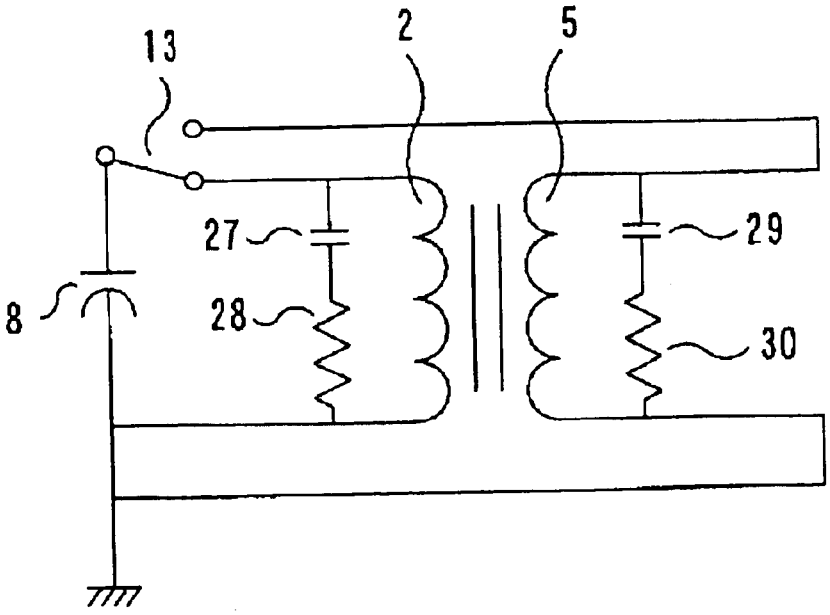
FIG. 7 is an operation circuit diagram according to another embodiment of the invention.

As shown in FIG. 7, a capacitor 27 and a resistor 28 are disposed in parallel to the opening coil 2, and a capacitor 29 and a resistor 30 are disposed in parallel to the closing coil 5. Thus, in response to any change in current of which falling is sharp in the case of making an excitation current OFF with the use of the discharge switch 13 or the discharge switch 14 (not shown), a composite impedance of the capacitor 27 and resistor 28 and a composite impedance of the capacitor 29 and resistor 30 come to be smaller than impedances of the mentioned opening coil and closing coil respectively.

Therefore, for example, at the moment of making the discharge switch 13 OFF, current comes to circulate between the opening coil 2, thereby the capacitor 27 and the resistor 28 resulting in gradual attenuation of current in accordance with impedance of the circulation circuit.

As a result, voltage generated across both terminals of the opening coil 2 can be suppressed in accordance with the expression (1).

On the other hand, as for an induction current through the closing coil 5 on the opposed non-excitation side, the change in current is so slow as that in excitation current. In this case, since a composite impedance of the capacitor 29 and resistor 30 becomes larger than the impedance of the mentioned closing coil, no current flows into the circulation circuit. Therefore there is no generation of an induction current.

In the drawing, to act as means for suppressing the over-voltage at the moment of interrupting an excitation current of the opening coil, as well as for interrupting an induction current generated through the opening coil at the moment of exciting the closing coil, there are provided the capacitor 27 and the resistor 28 that are connected in parallel to the coil and connected in serial to each other.

Further, it is shown in the drawing that there are provided the capacitor 29 and the resistor 30 that are connected in parallel to the coils, and connected in serial to each other to act as means for suppressing the over-voltage at the moment of interrupting an excitation current of the closing coil, as well as for interrupting an induction current generated through the closing coil at the moment of exciting the opening coil.

Figure 8:
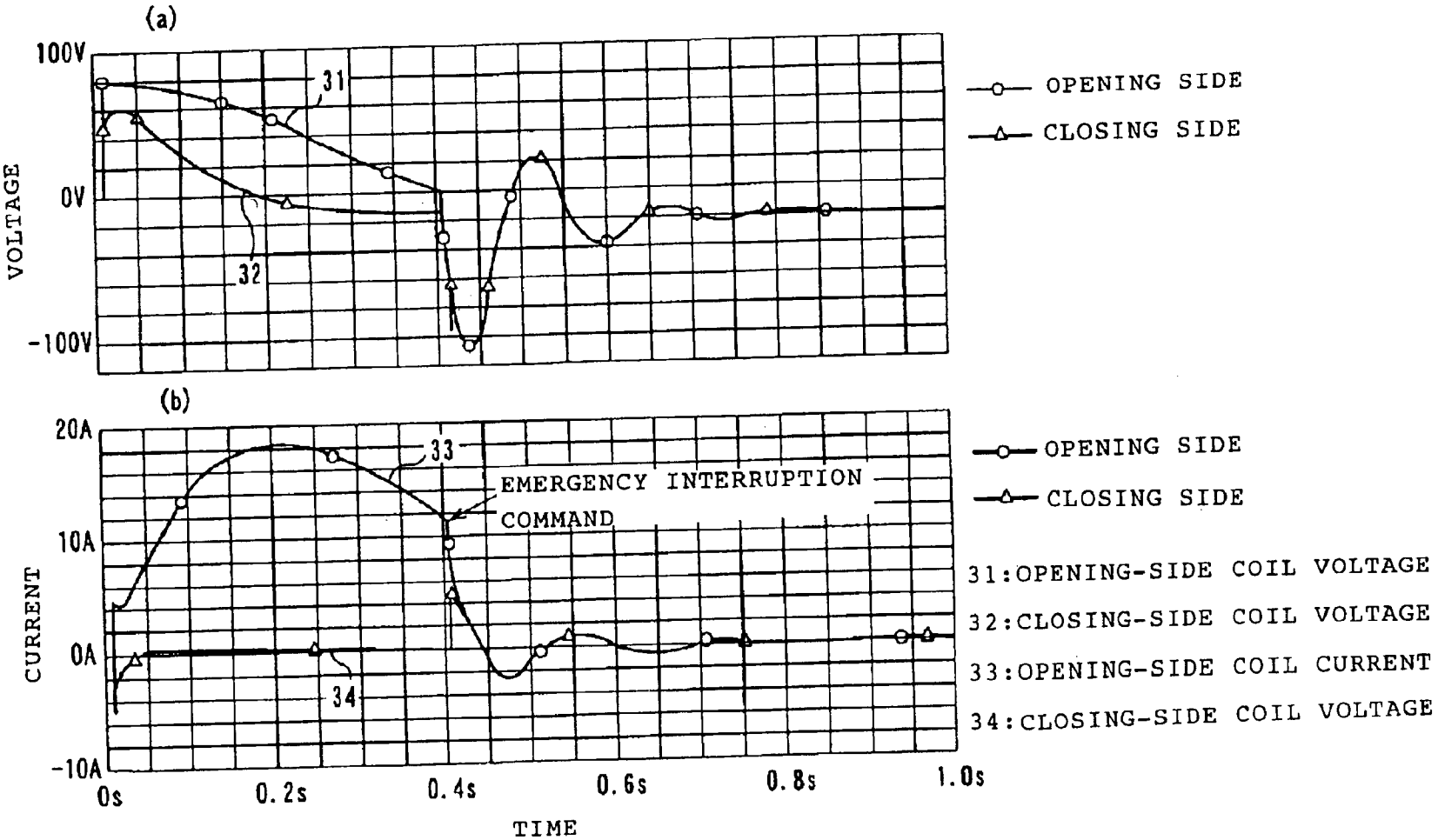
FIGS. 8 (*a*) and 8 (*b*) are simulation examples of a circuit, each showing technical effects of the operation circuit according to another embodiment of the invention.

FIGS. 8(*a*) and 8(*b*) show results, which are obtained on the test of effects by a circuit analysis.

As an example, FIG. 8(*a*) shows waveforms of voltage across the terminals of the opening coil 2 and across those of the opposed closing coil 5 in the case of discharging electric energy to the opening coil 2. FIG. 8(*b*) shows conduction current through the opening coil 2 and the opposed closing coil 5.

It is understood from FIG. 8(*a*) that in the case of receiving an emergency interruption command and instantaneously interrupting current through the opening coil 2, voltage 31 between the terminals of the opening coil 2 is suppressed to a degree of about −100V, whereby the opening coil 2 is protected from the over-voltage. It is further understood from FIG. 8(*b*) that current 34 through the closing coil 5 during current-carrying through the opening coil 2 is suppressed to substantially zero, whereby an induction current due to magnetic coupling is cut.

Furthermore, although one opening coil and one closing coil are respectively shown in the foregoing explanation, it is a matter of course to achieve the same effects even in the case of a plurality of coils As shown in FIG. 1.

Embodiment 5

Figure 9:
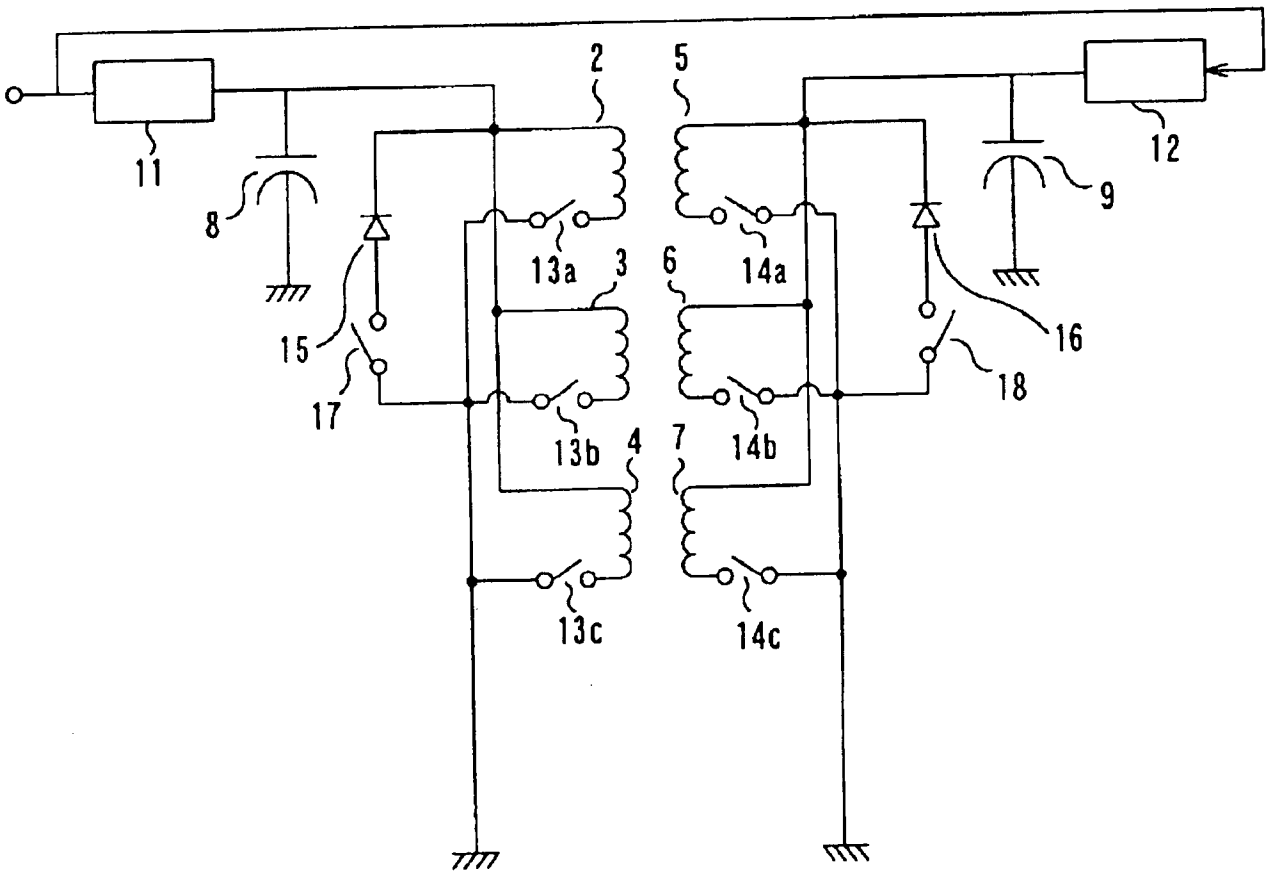
FIG. 9 is operation circuit diagram according to a further embodiment of the invention.

In case of FIG. 1, there are disposed the discharge switches 13, 14 respectively on each of the opening and closing sides. However, even when the discharge switches are disposed individually at each phase and at each electrode, for example, as shown with the discharge switches 13*a*–13*c*, and 14*a*–14*c* in FIG. 9, there is no difference in effects according to the foregoing embodiments 1 to 3.

Furthermore, arrangement of the discharge switches located individually at each phase and at each electrode enables the control of individually opening or closing each phase, resulting in advantage that application of this device to a phase control breaker becomes possible.

Embodiment 6

Figure 10:
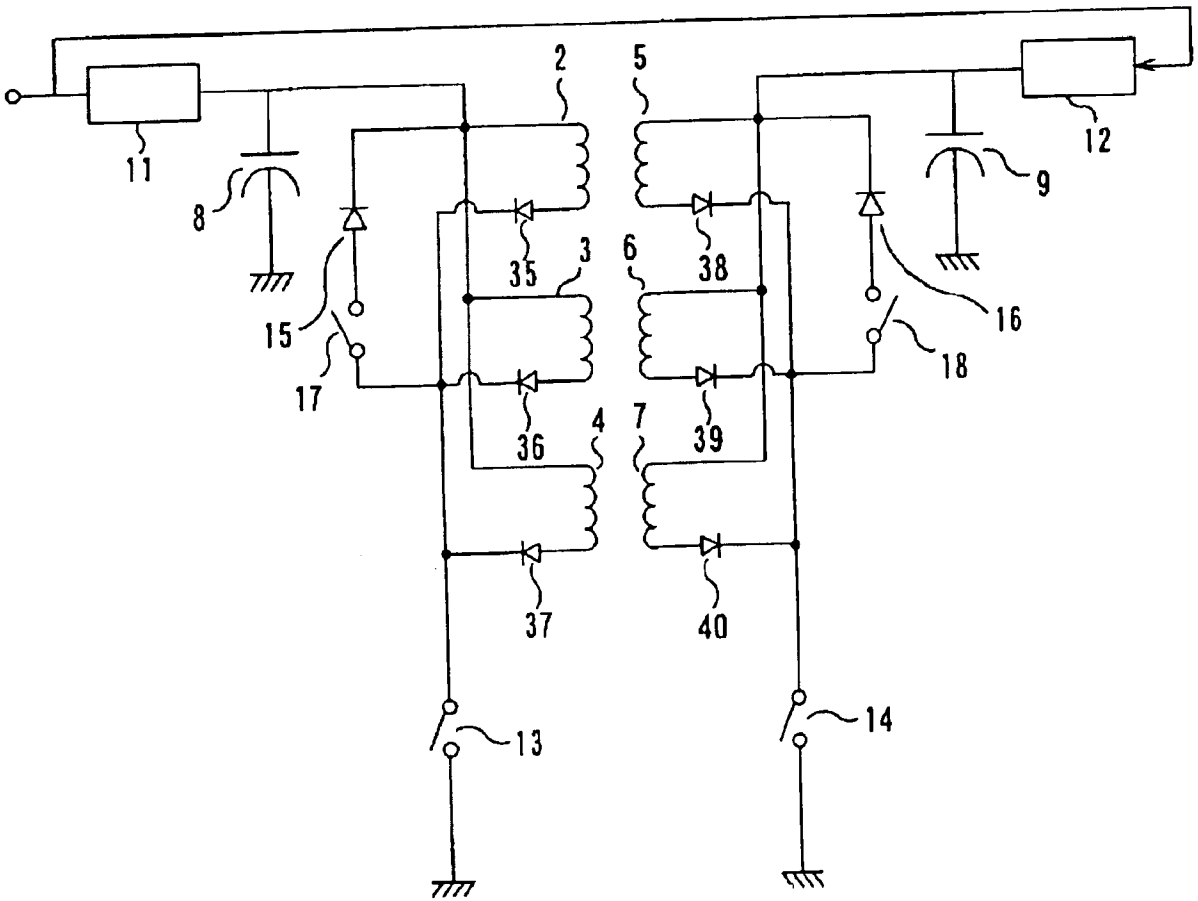
FIG. 10 is an operation circuit diagram according to a still another embodiment of the invention.

FIG. 10 shows an arrangement in which diodes 35–40 are disposed in serial respectively to each of the opening coils 2–4 and the closing coils 5–7

By this arrangement, for example, it becomes possible to prevented an induction current from circulating within the three-phase coils due to difference in self-impedances of the opening coils 2–4, resulting in advantage of suppressing fluctuation in operation between the three phases.

Embodiment 7

In the mentioned embodiments 1–5, a capacitor is employed as excitation means of a coil. However, a direct excitation from a DC power supply brings about the same effects.

Embodiment 8

As shown in FIG. 7, there are provided capacitors respectively one on each of the whole opening side and the whole closing side with accompanying construction in which there is provided only one charge circuit with respect to the unit of both sides, thereby enabling to reduce number of parts of the circuit resulting in improvement in reliability.

Embodiment 9

Figure 11:
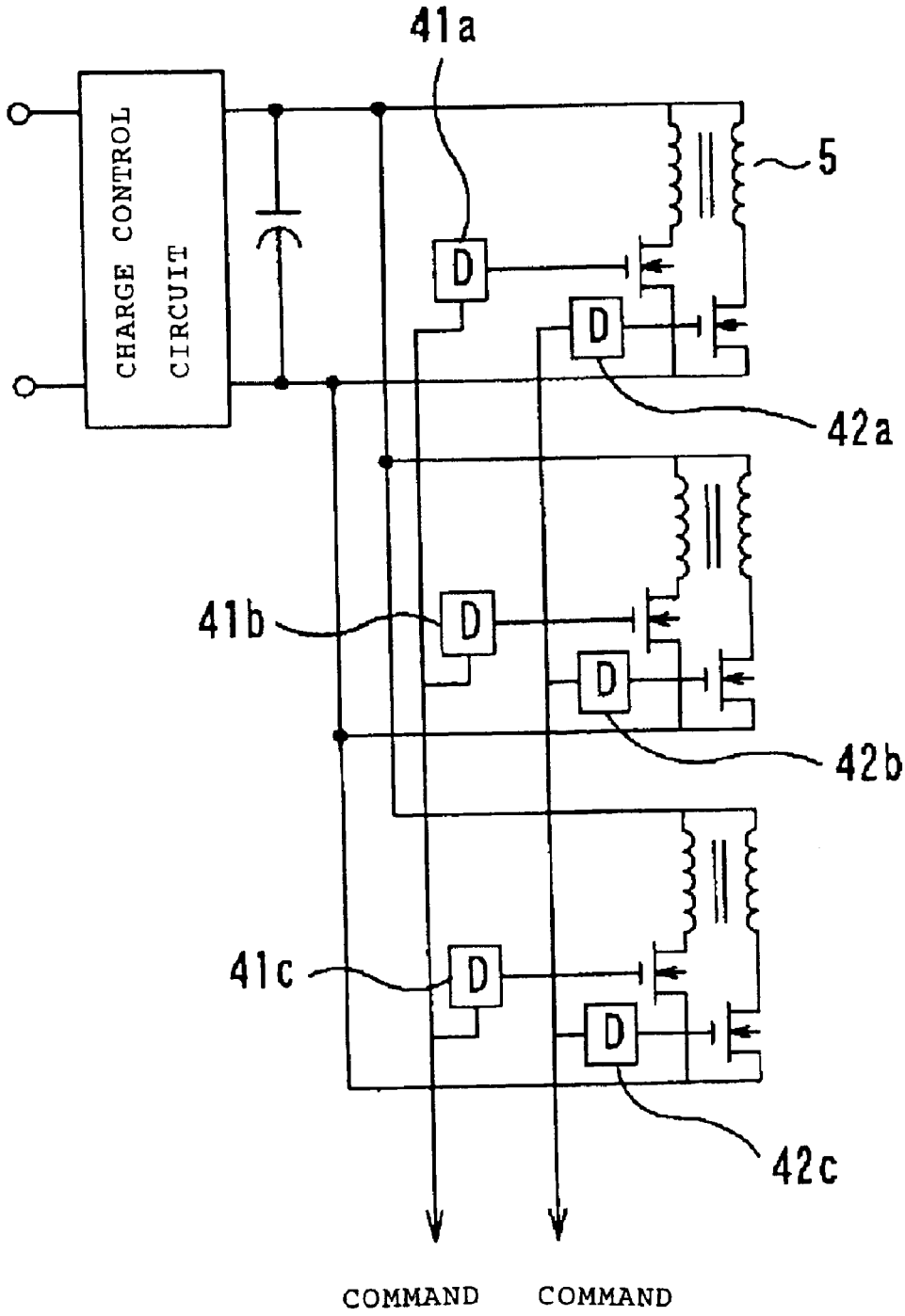
FIG. 11 is an operation circuit diagram according to a yet another embodiment of the invention.

FIG. 11 shows layout of commons 41*a*, 41*b*, 41*c*, 42*a*, 42*b*, 42*c* of a circuit according to this invention.

As shown in FIG. 11, the commons are disposed on the side of a positive electrode of the discharge circuit, thereby making insulation of the common circuit unnecessary. This brings about reduction in number of parts resulting in advantage of higher reliability and cost reduction.

Embodiment 10

Figure 12:
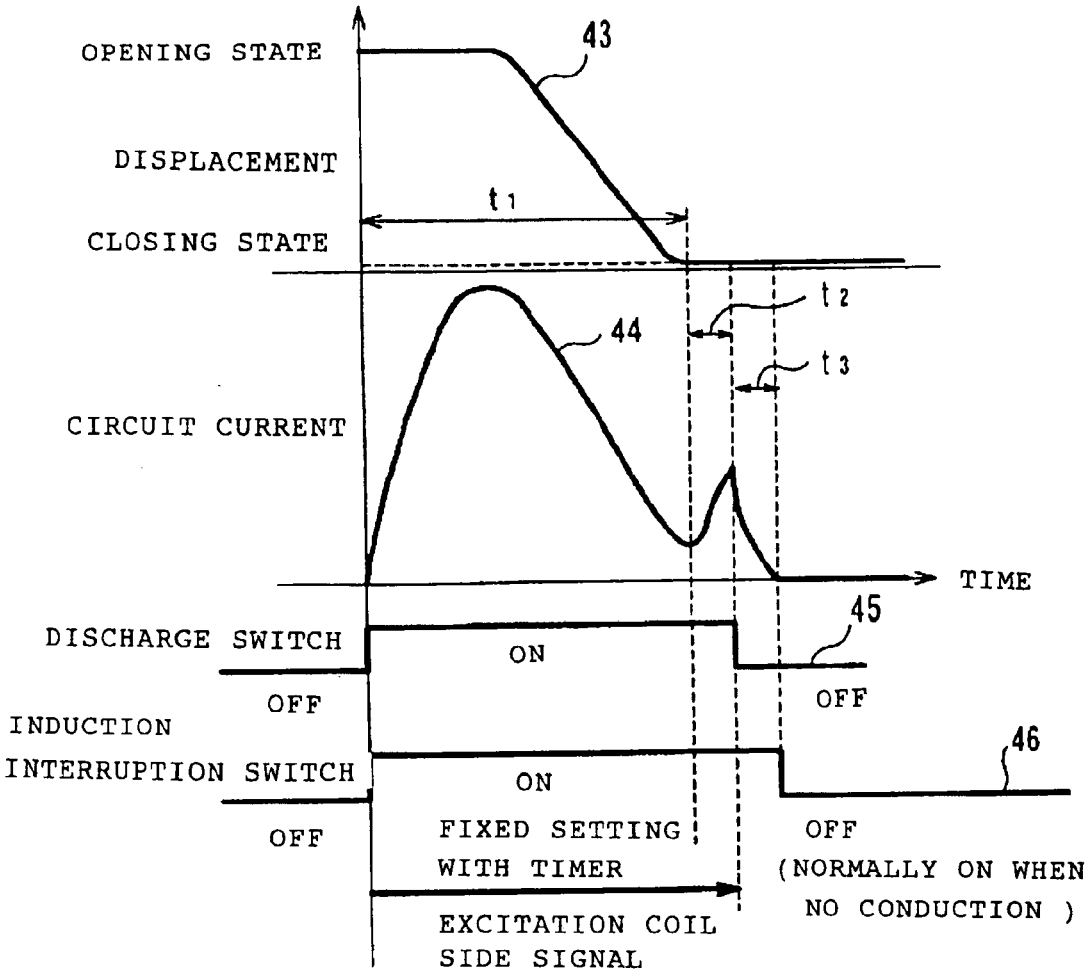
FIG. 12 is a pattern chart of current through the operation circuit and displacement of a moving element according to the invention.

FIG. 12 shows, as an example of conditions of the change over time of each component of the present switching device at the time of a closing operation, a change 43 in displacement of the moving element 22, a conduction current waveform 44 of the closing coils 5–7, a timing chart 45 of the discharge switch 14, and a timing chart of the induction interruption switch 18.

In the drawing, ti denotes a conduction time period; t2 denotes a time period from the completion of the closing operation until the discharge switch 14 is made OFF; and t3 denotes a time period from OFF of the discharge switch 14 until the conduction current comes to be a value of substantially zero (value regarded as zero).

When a closing command is received by the power switching device 24, the induction interruption switch 18, which is connected in parallel to the closing coils 5–7, is made ON, at the same time or thereafter, the discharge switch 14 is made ON, and current is discharged from the closing capacitor 9 to the closing coils 5–7. However, since this current is gradually increased by degrees, it is possible to prevent the coils from occurrence of the over-voltage.

The discharge of current to the closing coils 5–7 causes the moving element 22 to move from the opening state to the closing state by an electromagnetic force and to be held in the closing state due to magnetic flux provided by the permanent magnet 23.

At this moment, since there is provided in the operation circuit 1 means for making current OFF after a predetermined time width such as timer or delay switch having a time width sufficient to complete the closing operation, the discharge switch 14 is made OFF, and conduction through the closing coils is brought into OFF. Thus, OFF of the discharge switch 14 can be carried out without any special current detector.

At the moment of making the mentioned discharge switch 14 OFF, the induction interruption switch 18 is in the ON state, and therefore the OFF current circulates to the side of the induction interruption switch 18 and the diode 16, and comes to attenuate by degrees. Accordingly, no over-voltage occurs between terminals of the closing coils 5–7, thereby enabling to prevent the closing coils 5–7 from dielectric breakdown.

On the other hand, when the induction interruption switch 18 is brought into OFF during dropping of current at the time of OFF of the closing coils 5–7, current at the moment of making the closing coils OFF comes instantaneously to be zero. Therefore, it is possible that the over-voltage occurs between the terminals of the closing coils 5–7.

In the operation circuit according to the invention, the induction interruption switch 18 is set to be OFF with a predetermined time width from OFF of the discharge switch 14 until current through the closing coils 5–7 comes to a value substantially zero (value regarded as zero). Thus, the closing coils 5–7 can be prevented from over-voltage. It is possible to easily calculate these predetermined time widths by inspection at the time of dispatching products.

The induction interruption switch 18 is set so as to be still kept in the OFF state after the whole conduction sequence has completed, thereby enabling to prevent an induction current from flowing through the closing coils 5–7, which is located on the side of non-excitation, without need to make the induction interruption switch 18 OFF at the time of the next interruption operation. Consequently, efficiency at the time of the opening operation can be improved.

Further, for manually operating the interruption at the time of power outage, it is possible that magnetic flux of the permanent magnet 23 changes due to movement of the moving element, and an induction current is excited through the closing coils 5–7. However, since the induction interruption switch 18 has been in the OFF state when there is no conduction after the last closing operation has completed, no induction current flows through the closing coils 5–7, thereby enabling to carry out manual interruption operation smoothly as well as reliably.

Embodiment 11

Figure 13:
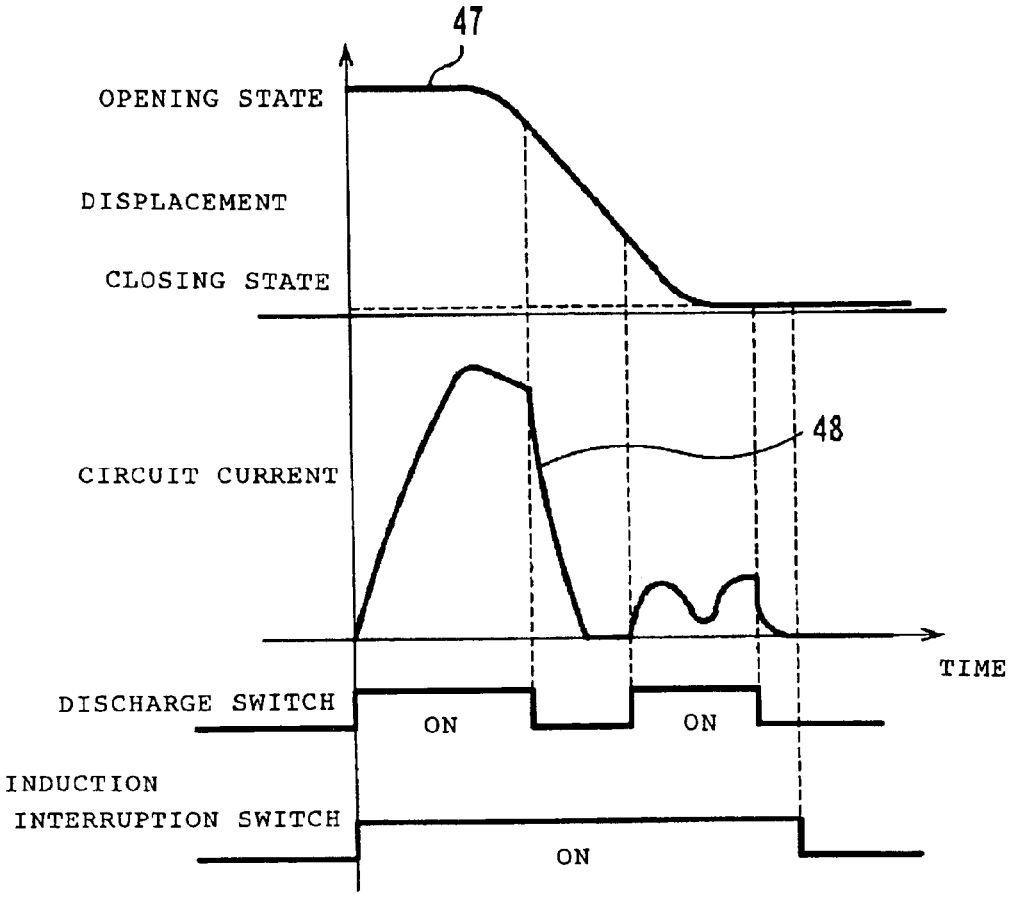
FIG. 13 is a pattern chart of current through the operation circuit and displacement of a moving element according to another embodiment of the invention.

FIG. 13 shows change 47 in displacement of the moving element 22 and a conduction current waveform 48 of the closing coils 5–7 at the time of the closing operation.

In general, a large shock is applied to the vacuum valve 26 at the moment of the closing operation, so that it is necessary in the normal circuit breaker to suppress the moving rate of the moving element 22 at the time of the closing operation to be not more than a predetermined level for the purpose of assuring a high durability of the vacuum valve 26.

On the other hand, in the operation mechanism 19, an electromagnetic force exerted on the moving element becomes larger, and acceleration of the moving element is likely to increase as it approaches to the closing state.

To cope with this, as shown in FIG. 13, the discharge switch 14 is once made OFF and the conduction current is interrupted after the moving element has been accelerated sufficiently, thereby suppressing the acceleration due to electromagnetic force. Then, the discharge switch 14 is made ON again, and current is carried again immediately before closing, thereby enabling to prevent chattering that is a bounding phenomenon at the time of closing.

Consequently, the shock applied to the vacuum valve 26 can be suppressed to the minimum, thereby assuring a longer operation life of the breaker and a higher reliability.

In the foregoing embodiments, an operation circuit of the power-switching device is mainly described as an example. This invention, however, is not limited to this example, and it is a matter of course that the invention can be applied to any other operation circuit for an operation mechanism such as valve control, fuel pump control or linear oscillator for use in an automobile.

Furthermore, in the embodiments, an operation mechanism, which is different in arrangement from the conventional embodiments, is referred and described. However, a targeted operation mechanism may have any other configuration. As far as it is an operation mechanism driven by a plurality of coils with magnetic coupling through the action of an electromagnetic force, this invention can be applied to any other mechanism as a matter of course.

While the presently preferred embodiments of the present invention have been shown and described. It is to be understood that these disclosures are for the purpose of illustration and that various changes and modifications may be made without departing from the scope of the invention as set forth in the appended claims.

What is claimed is:

1. An operation circuit of an operation mechanism that includes first and second coils arranged so that a moving element may be driven between the coils the operation circuit comprising means for suppressing an over-voltage upon interrupting an excitation current of the first coil and for interrupting an induction current generated through the first coil when the second coil is excited.

2. The operation circuit according to claim 1, wherein the means for suppressing is connected in parallel to the first and second coils, and consists of diodes and induction interruption switches.

3. The operation circuit according to claim 1, wherein the means for suppressing is connected in parallel to the first and second coils, and consists of capacitors and resistors.

4. The operation circuit according to claim 1, including coil excitation means, respective capacitors for each of the first and second coils, and a single charging circuit for all of the capacitors.

5. The operation circuit according to claim 1, including discharge switches turned ON in synchronization with or after turning ON induction interruption switches.

6. The operation circuit according to claim 1, including induction interruption switches turned OFF after a predetermined time period has passed since excitation means of the first and second coils has turned OFF.

7. The operation circuit according to claim 1, including induction interruption switches turned OFF when no current is carried through the first and second coils.

8. The operation circuit according to claim 1, wherein an excitation current for driving a moving element is carried through the first coil, and subsequently terminated after a predetermined time period has passed, and then turned ON again after a predetermined time period before completion of operation of the moving element.

9. A power-switching device including the operation circuit according to claim 1.

10. The operation circuit according to claim 2, including discharge switches turned ON in synchronization with or after turning ON the induction interruption switches.

11. The operation circuit according to claim 2, wherein the induction interruption switches are turned OFF after a predetermined time period has passed since excitation means of the first and second coils has turned OFF.

12. The operation circuit according to claim 2, wherein the induction interruption switches are turned OFF when no current is carried through the first and second coils.

13. The operation circuit according to claim 2, wherein an excitation current for driving a moving element is carried through the first coil and subsequently terminated after a predetermined time period has passed, and then turned ON again after a predetermined time period before completion of operation of the moving element.

* * * * *